US009653821B1

(12) United States Patent
Obeidat et al.

(10) Patent No.: US 9,653,821 B1
(45) Date of Patent: May 16, 2017

(54) DUAL BAND ANTENNA WITH A FIRST ORDER MODE AND A SECOND ORDER MODE

(71) Applicant: Amazon Technologies, Inc., Seattle, WA (US)

(72) Inventors: Khaled Ahmad Obeidat, Santa Clara, CA (US); Ming Zheng, Cupertino, CA (US); Adrian Napoles, Cupertino, CA (US); Peter Eli Renner, Sunnyvale, CA (US); Cheng Jung Lee, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/751,539

(22) Filed: Jun. 26, 2015

(51) Int. Cl.
*H01Q 21/30* (2006.01)
*H01Q 7/00* (2006.01)
*H01Q 13/10* (2006.01)

(52) U.S. Cl.
CPC ..... *H01Q 21/30* (2013.01); *H01Q 7/00* (2013.01); *H01Q 13/106* (2013.01)

(58) Field of Classification Search
CPC ..... H01Q 1/007; H01Q 1/2216; H01Q 1/243; H01Q 1/244; H01Q 1/362; H01Q 1/405; H01Q 1/42; H01Q 1/38; H01Q 1/48; H01Q 21/24; H01Q 21/204; H01Q 9/0407; H01Q 21/30; H01Q 7/00; H01Q 13/106
USPC ..... 343/702, 729, 895, 853
See application file for complete search history.

(56) References Cited

U.S. PATENT DOCUMENTS 6,255,999 B1 * 7/2001 Faulkner ..... H01Q 1/243 343/702
6,266,836 B1 * 7/2001 Gallego Juarez ..... D06B 13/00 134/1
6,268,836 B1 * 7/2001 Faulkner ..... H01Q 1/243 343/702
9,325,070 B1 * 4/2016 Obeidat ..... H01Q 9/0407
2006/0017635 A1 * 1/2006 Zheng ..... H01Q 7/00 343/748
2007/0222699 A1 * 9/2007 Modro ..... H01Q 1/243 343/873
2009/0295567 A1 * 12/2009 Bellows ..... H01Q 1/2216 340/539.11
2010/0315303 A1 * 12/2010 Kearney ..... H01Q 1/36 343/767
2011/0063180 A1 * 3/2011 Su ..... H01Q 3/24 343/795
2014/0361931 A1 * 12/2014 Irci ..... H01Q 1/243 343/702

* cited by examiner

*Primary Examiner* — Lam T Mai
(74) *Attorney, Agent, or Firm* — Lowenstein Sandler LLP

(57) ABSTRACT

An antenna structure with a radio frequency (RF) circuit, an antenna carrier, and conductive material disposed on the antenna carrier and coupled to the RF circuit slot is described. The conductive material can radiate or receive first electromagnetic energy as a loop antenna in a first frequency band in a second order mode. The conductive material can include a first slot between portions of the conductive material and a second slot between other portions of the conductive material. The first slot or the second slot can radiate or receive second electromagnetic energy as a slot antenna at a second frequency band in a first order mode. The second frequency band can be higher than the first frequency band.

18 Claims, 8 Drawing Sheets

600

DUAL BAND ANTENNA WITH A FIRST ORDER MODE AND A SECOND ORDER MODE

BACKGROUND

Electronic devices can be used for cellular communication, internet browsing, digital broadcast reception, navigation, gaming, and so forth. The electronic devices (e.g., user devices) can be electronic book readers, cellular telephones, personal digital assistants (PDAs), portable media players, tablet computers, netbooks, laptops, and so forth. To wirelessly communicate with other devices, these electronic devices can include antennas, such as a personal area network (PAN) antenna, a wireless area network (WAN) antenna, a wireless local area network (WLAN) antenna, and/or a cellular network antenna.

As demand for miniaturized and multifunctional electronic devices continues to increase, demands on antennas of the electronic devices may also increase to satisfy consumers' needs. To meet the increasing demand on the antennas, electronic device may operate on multiple bands. To communicate on multiple bands the electronic devices can use multiple antennas.

Many electronic devices may have multiple antennas configured to transmit and/or receive signals at different frequencies or for different types of wireless communications networks and cellular communications networks. The multiple antennas can be configured to communicate on one or more types of communication networks, such as communications networks using Bluetooth® technology, the Zigbee® technology, the Wi-Fi® technology, or various cellular communication technologies. However, as the number of frequencies that the device may be configured to communicate at increase, so does the number of antennas. To reduce the number of antennas in a device, an antenna can be configured as a multiple band antenna to communicate at multiple frequencies.

BRIEF DESCRIPTION OF DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
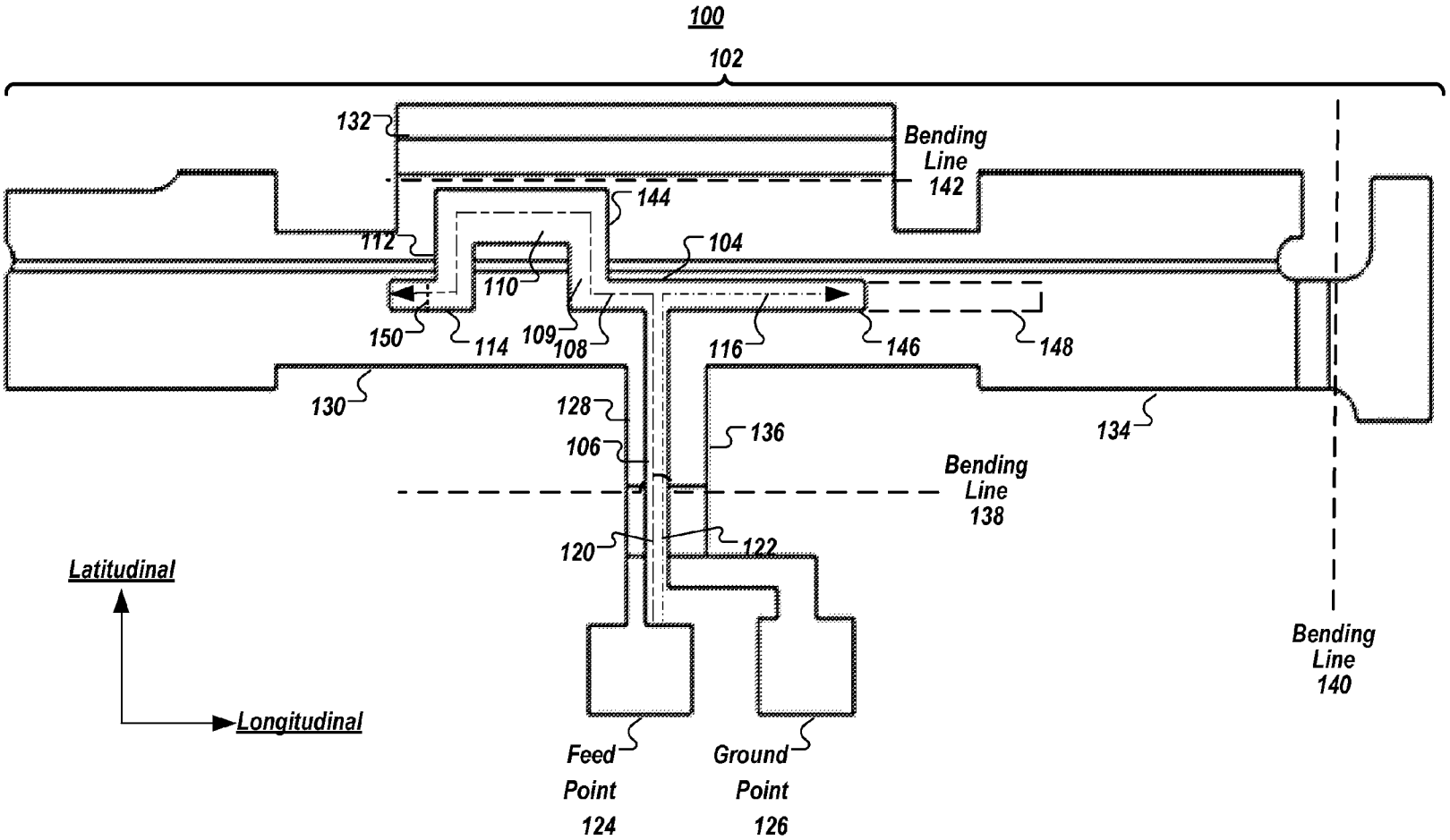
FIG. 1A illustrates a flattened two-dimensional view of a dual band antenna structure with a loop antenna and a slot antenna according to one embodiment.

Electronic devices traditionally use conventional antennas that may be externally mounted to the electronic devices (e.g., external antennas) to avoid interference from internal components of the electronic devices and/or a housing of the electronic devices. As electronic devices continue to be miniaturized, antennas may be integrated within the electronic devices to increase a functionality and aesthetic design of the electronic devices.

With the integration of an antenna into an electronic device, a material of a housing of the electronic device can play an increasing role in a level of interference generated by the electronic device for the integrated antenna when the electronic device communicates data. For example, to provide durability and ruggedness, an electronic device can have a primarily metal housing. However, the metal housing may reflect electromagnetic waves communicated between the integrated antenna and another antenna. The reflection of the electromagnetic waves can interfere with the integrated antenna transmitting and receiving signals. Additionally, traditional integrated antennas may not have sufficient bandwidth to meet a bandwidth demand for services used by the electronic device.

The embodiments described herein may address the above noted deficiencies by an electronic device using a dual band antenna configured to communicate using a second order mode for a low frequency communication band using a loop antenna and first order mode for the high frequency communication band using a slot antenna. For example, the dual band antenna can have a resonant structure of a first order mode. The order mode of an antenna is a resonant frequency of the antenna that varies with an electrical length (L) of the dual band antenna. In this example, the dual band antenna can include of a conductive wire (transmission line) which can have an electrical length of $\lambda/2$ of a wavelength $\lambda$ corresponding to a desired frequency. An electromagnetic wave guided along the conductive wire forms a standing wave inside the conductive wire to generate a resonance. The electrical length of the dual band antenna with the resonant structure of a first order mode is determined by the resonant frequency of the dual band antenna, and the size of the antenna also depends on the resonant frequency. The resonant modes (e.g., the first order mode and the second order mode) of the dipole antenna can be a function of antenna geometry, where odd modes such the second order mode can be excited when the feed to the antenna may be placed off-center.

The low frequency (e.g., a second mode of the loop antenna) can be lower than the high frequency (e.g., a first mode of the slot antenna). The dual band antenna can include a loop antenna and a slot antenna to resonate at different frequencies for communication on different frequency bands with various types of transmitters and receivers. One advantage of the dual band antenna using the second order mode of the loop antenna for the low band and the first order mode of the slot antenna for the high band can be to balance the current modes of the dual band antenna (minimal current on a device ground) to avoid a strong current cancelation caused by metallic components of an electronic device, such as a metallic housing. For example, at a low band the dual-band antenna can resonate when its electrical length is equal to $\lambda$ (a dipole mode), while at a high frequency the slots within the antenna structures can have a length equal to λ/2 (a magnetic dipole mode).

Figure 1B:
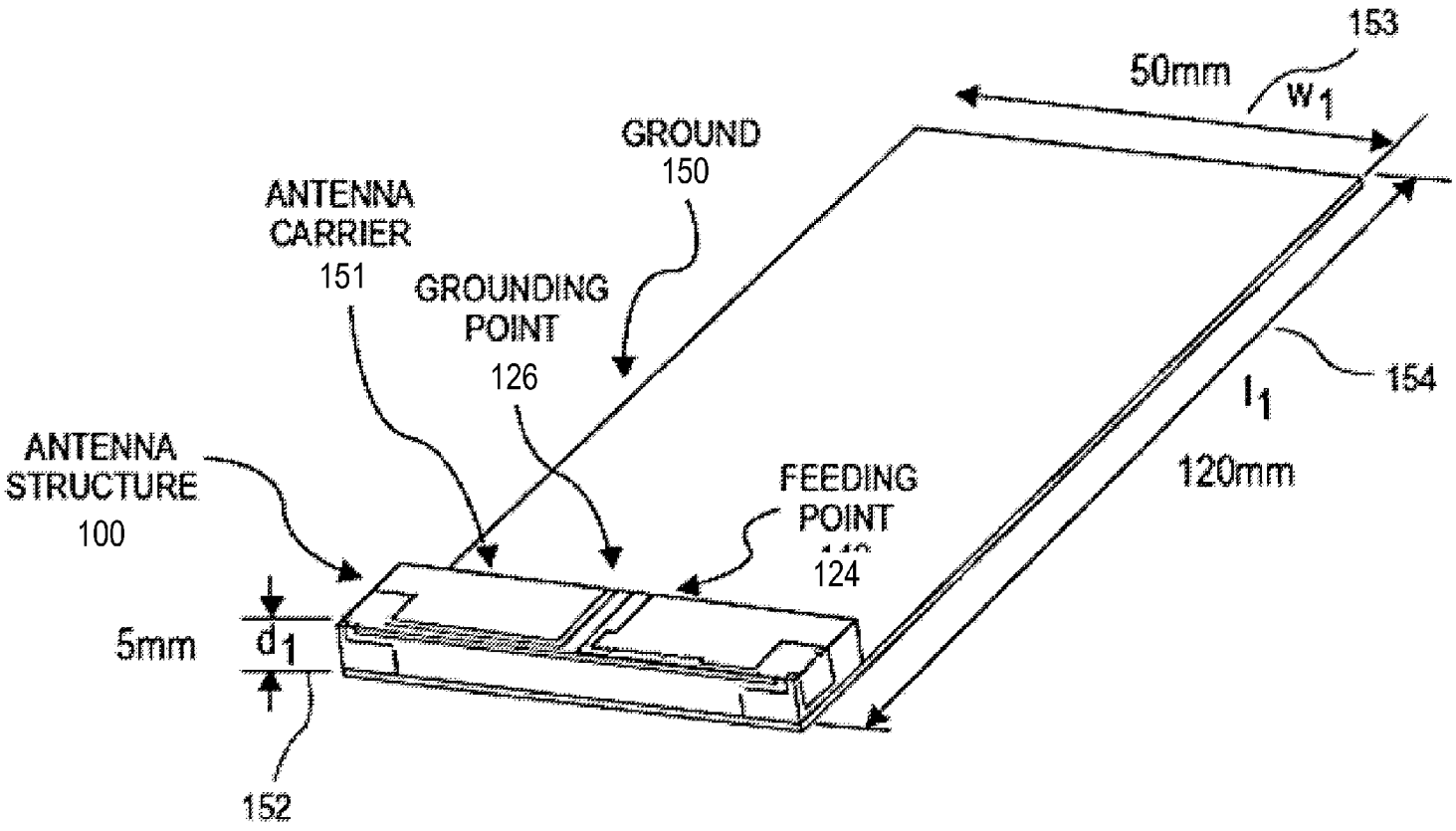
FIG. 1B illustrates a three-dimensional view of a dual band antenna structure according to one embodiment

FIG. 1A illustrates a flattened two-dimensional view of a dual band antenna structure 100 with a loop antenna 102 and a slot antenna 104 according to one embodiment. The antenna structure of the loop antenna 102 may be folded up around the bending lines 138, 140, and/or 142 to illustrate that the dual band antenna structure 100 can have a three dimensional (3D) structure. In one example, the dual band antenna structure 100 can be folded around an antenna carrier 151 as shown in FIG. 1B. For example, the eighth portion, the tenth portion, and the twelfth portion of the loop antenna can be disposed along a first side and at least a portion of the eighth portion, the tenth portion, and the twelfth portion can be disposed on a second side of the antenna carrier.

In the depicted embodiment, the antenna structure can include a multiple conductive material or traces coupled between a feed point and a ground point, where the multiple of conductive traces can form a loop antenna to radiate electromagnetic energy with a second order mode and gaps between some of the plurality of conductive traces can form a slot antenna to radiate electromagnetic energy in a first order mode.

The slot antenna 104 can operate at a high band for a first order mode, e.g., 0.5 wavelength (λ). In another embodiment, the slot antenna 104 can be a half wavelength slot antenna. The slot antenna 104 can include a first portion 106 that extends from feed point 124. In one embodiment, the first portion 106 can be a slot in the conductive material of the antenna structure on the antenna carrier can be perpendicular to the feed point 124 and can extend along a latitudinal axis. The slot antenna 104 can split at an end opposite feed point 124 into a first slot 144 in the conductive material of the antenna structure on the antenna carrier and a second slot 146 in the conductive material of the antenna structure on the antenna carrier. An advantage of the slot antenna 104 including the first slot 144 and the second slot 146 can be to provide flexibility as to which slot of the slot antenna 104 may be used to radiate electromagnetic energy. In one example, the first slot 144 can be a dominant radiator (e.g., radiate electromagnetic energy) when the first slot 144 may be longer than the second slot 146. In another example, the second slot 146 can be the dominant radiator (e.g., radiate electromagnetic energy) when the second slot 146 may be longer than the first slot 144. In one example, the second slot 146 can be an extended second slot 148 with a slot length that is longer than the first slot 144. In another example, the first slot 144 can be shortened first slot 150 with a slot length that is shorter than the second slot 146. In another example, a length of the first slot 144 and the second slot 146 can have an electrical length of λ/2 of a wavelength λg (e.g., a guided wavelength or non-free space) corresponding to a frequency of the slot antenna 104.

The first slot 144 can include a second portion 108 that can be perpendicular to the first portion 106 and extend in a first direction from the first portion 106 to a third portion 109 along a longitudinal axis. The third portion 109 that can be perpendicular to the second portion 108 and extend from the second portion 108 to a fourth portion 110 along the latitudinal axis. The fourth portion 110 can be perpendicular to the third portion 109 and extend from the third portion 109 to a fifth portion 112 along the longitudinal axis. The fifth portion 112 can be perpendicular to the fourth portion 110 and extend from the fourth portion 110 to a sixth portion 114 along the latitudinal axis. The sixth portion 114 that can be perpendicular to the fifth portion 112 and extend from the fifth portion 112 along the longitudinal axis. The second slot 146 can include a seventh portion 116 that can be perpendicular the first portion 106 and extend in a second direction from the first portion 106 along the longitudinal axis.

In one example, the slot antenna 104 can have a first mode 120 and a second mode 122. In one embodiment, surface currents of the slot antenna 104 can be distributed in the first mode 120 from the opening 105 to the sixth portion 114. In another embodiment, the surface currents of the slot antenna 104 can be distributed in the second mode 122 from the opening 105 to the seventh portion 116. The number of slots in the preceding paragraphs and as illustrated in FIG. 1A is not intended to be limiting, but rather exemplify that the slot antenna 104 may include multiple slots. In another example, the slot antenna 104 can include various numbers of slots, such as 1 slot, 2 slots, 3 slots, 4 slots, and so forth.

In the depicted embodiment, the loop antenna 102 can include an eighth portion 128 that extends from a feed point 124. In one embodiment, the eighth portion 128 can be perpendicular to the feed point 124 and can extend from the feed point 124 to a ninth portion 130 along the latitudinal axis. The ninth portion 130 can be perpendicular to the eighth portion 128 and can extend from the eighth portion 128 to a tenth portion 132 along the longitudinal axis. The tenth portion 132 can be parallel to the ninth portion 130 and can extend from the ninth portion 130 to an eleventh portion 134 along the longitudinal axis. The eleventh portion 134 can be parallel to the tenth portion 132 and can extend from the tenth portion 132 to a twelfth portion 136 along the longitudinal axis. The twelfth portion 136 can be perpendicular to the eleventh portion 134 and can extend from the eleventh portion 134 to a ground point 126 along the latitudinal axis. In one example, at least a portion of the eighth portion 128, the tenth portion 132, and/or the twelfth portion 136 of the loop antenna 102 can be folded (such as a distal bend) along the bending lines 138, 140, or 142, respectively. In another example, when the seventh portion 116 may have a shorted portion or an RF short, the feed point 124 and the ground point 126 can be switched.

FIG. 1B illustrates a three-dimensional view of a dual band antenna structure 100 of FIG. 1A according to one embodiment. In this embodiment, the dual band antenna structure 100 can fed at a feed point 124 at a first end of the dual band antenna structure 100 and a second end of the dual band antenna structure 100 can be coupled to a radiation ground plane 150. The ground plane 150 may be a metal frame of a user device. The ground plane 150 may be a system ground or one of multiple grounds of the user device. The feed point 124 (such as an RF input) may be a feed line connector that couples the dual band antenna structure 100 to a feed line (also referred to as the transmission line), which is a physical connection that carriers the RF signal to and/or from the dual band antenna structure 100. The feed line connector may be any one of the three common types of feed lines, including coaxial feed lines, transmission lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the first end of dual band antenna structure 100.

In one embodiment, the dual band antenna structure 100 can be disposed on an antenna carrier 151, such as a dielectric carrier of the user device. The antenna carrier 151 may be any non-conductive material, such as dielectric material, upon which the conductive material of the dual band antenna structure 100 can be disposed without making electrical contact with other metal of the user device. In another embodiment, portions of the dual band antenna structure 100 may be disposed on or within a circuit board, such as a printed circuit board (PCB). Alternatively, the dual band antenna structure 100 may be disposed on other components of the user device or within the user device as would be appreciated by one of ordinary skill in the art having the benefit of this disclosure. It should be noted that the dual band antenna structure 100 illustrated in FIG. 1B is a three-dimensional (3D) structure. However, as described herein, the dual band antenna structure 100 may be implemented as a 2D structure as in FIG. 1A, as well as other variations than those depicted in FIG. 1B. In one embodiment, the dual band antenna structure 100 can be partially disposed on a side of the antenna carrier 151. For example, the dual band antenna structure 100 can be disposed on a side surface and a top surface of the antenna carrier 151. Alternatively, the dual band antenna structure 100 can be disposed on the front surface, the back surface, the top surface and zero or more of the two sides. Alternatively, portions of the dual band antenna structure 100 can be disposed in various configurations as would be appreciated by one of ordinary skill in the art having the benefit of this disclosure. However, as described herein, the dual band antenna structure 100 may be a planar 2D structure.

The dual band antenna structure 100 can create multiple resonant modes using a single RF input, a low band (LB) and a high band (HB). The dual band antenna structure 100 can include a circuit board with a transceiver and the ground plane 150, wherein the transceiver is configured to output radio frequency (RF) signals.

In the depicted embodiment, the dual band antenna structure 100 can be placed on the antenna carrier 151 having a depth (d1) 152 of 5 mm, a width (w1) 153 of 50 mm, and a height (h1) 151 of 13 mm. The antenna carrier 151 may be located at one end of a printed circuit board (PCB). The PCB may have a length (11) of 120 mm. In this embodiment, there is no ground plane clearance underneath the dual band antenna structure 100; therefore the total antenna volume is $50\times13\times5$ mm$^3$. Of course, in other embodiments, the dimensions may vary to achieve the same total antenna volume or different total antenna volumes. In another embodiment, the antenna carrier 151 is disposed a top end of the PCB. In another embodiment, the antenna carrier 151 is disposed to overlap a portion of the PCB. In one embodiment, the PCB may be made of a 0.8 mm thick FR4 substrate of size of $120\times50$ mm$^2$ with relative permittivity of 4.4 and loss tangent of 0.02. The antenna carrier 151 may be made of Polycarbonate/Acrylonitrile Butadiene Styrene (PC-ABS) with relative permittivity of 2.9 and loss tangent of 0.005. Of course, the PCB and antenna carrier 151 may be made of other materials as would be appreciated by one of ordinary skill in the art having the benefit of this disclosure. In another embodiment, portions of the dual band antenna structure 100 may be disposed on or within a circuit board, such as the depicted PCB. Alternatively, the dual band antenna structure 100 may be disposed on other components of the user device or within the user device as would be appreciated by one of ordinary skill in the art having the benefit of this disclosure.

Figure 2:
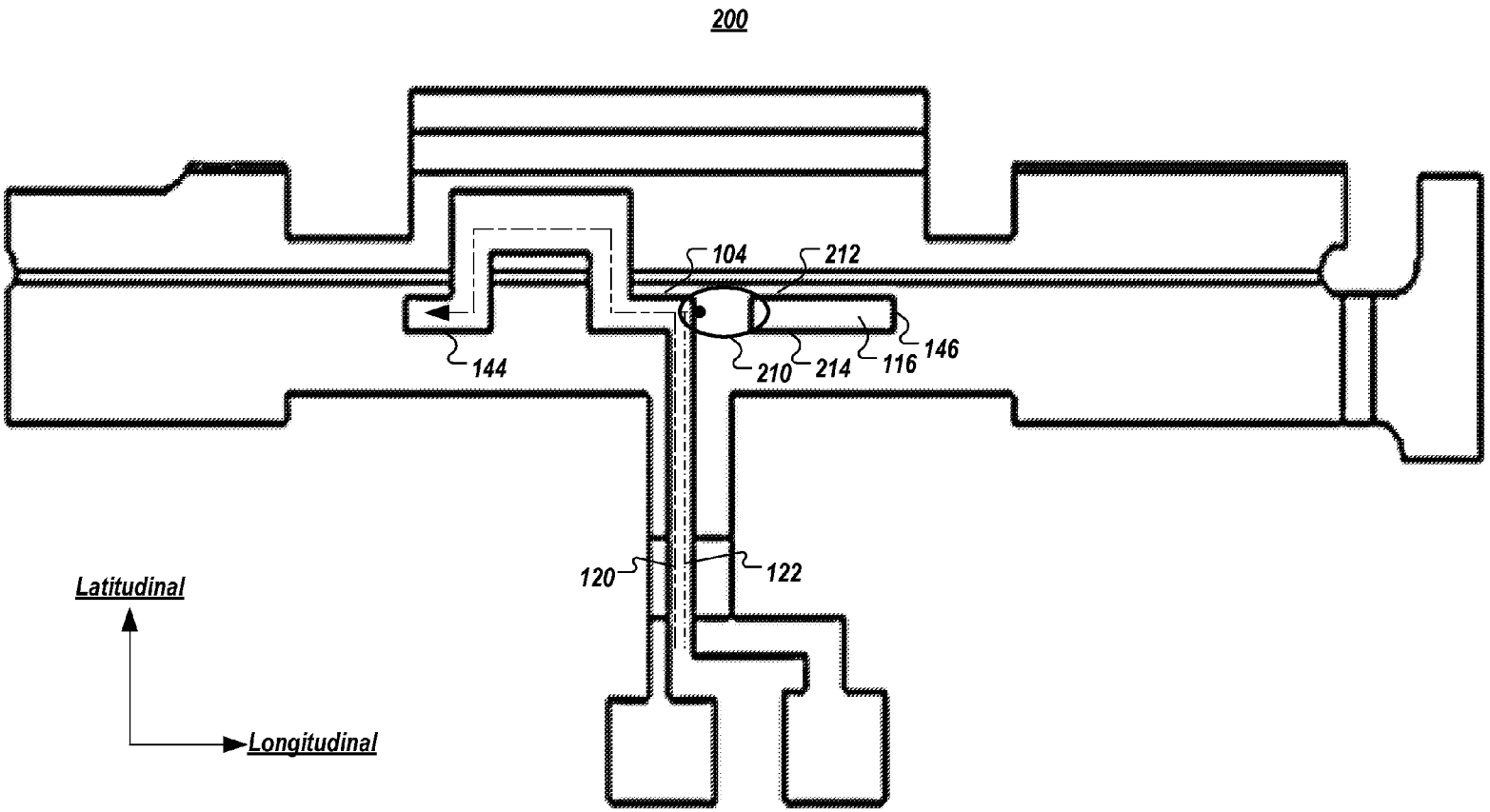
FIG. 2 illustrates the dual band antenna structure with slot antenna having an RF short according to one embodiment.

FIG. 2 illustrates the dual band antenna structure 200 with slot antenna 104 of FIG. 1A having a shorted portion or an RF short 210 according to one embodiment. The slot antenna 104 can include the seventh portion 116 with a shorted portion 210, such as a shorted post. The RF short 210 can connect a first side 212 of the conductive material along the seventh portion 116 together with a second side 214 of the conductive material along the seventh portion 116. In one embodiment, the RF short 210 can adjust a tuning of the slot antenna 104. For example, as discussed in the preceding paragraphs, the slot antenna 104 can have a first radiating mode 120 and a second radiating mode 122 in view of lengths of the first slot 144 and the second slot 146. In one embodiment, when the seventh portion 116 includes the RF short 210, the second slot 146 may be inactive, e.g., the surface currents may not propagate along the second slot 146. The first slot 144 may be active and the surface currents may propagate along the first slot 144. When the first slot may be dominant mode (e.g., in resonance) and the second slot may be a non-dominant mode (e.g., not in resonance), the slot antenna 104 can be tuned to a different frequency than when the first slot and the second slot may both be active.

In one example, the dual band antenna structure 200 can radiate efficiently at a low band using the loop antenna 102, such as a half wave length loop antenna. In this example, the low band mode can be the dual band antenna structure 200 operating in the second order mode of the loop antenna. In another example, the dual band antenna structure 100 can radiate efficiently at a high band using the slot antenna 104, such as a half wavelength slot antenna. In this example, a length and/or width of the first slot 144 and/or the second slot 146 of the half wavelength slot antenna 104 can be adjusted to tune the dual band antenna structure 200 independently from the low band mode of the half wavelength loop antenna 102. A length of the first slot 144 and/or the second slot 146 can be changed to switch of resonant modes of the first and second slot (e.g., whether the first slot or the second slot may resonate).

For example, a length of the second slot 146 can be increased or decreased to independently tune the high band of the half wavelength slot antenna 104 without degrading the low band of the half wavelength loop antenna 102. In another example, the second slot 146 can be shorted to independently tune the high band of the half wavelength slot antenna 104. In this example, when the second slot 146 may be shorted, only the first slot 144 may resonate at high bands and the half wavelength loop antenna 102 may resonate at low bands.

Figure 3:
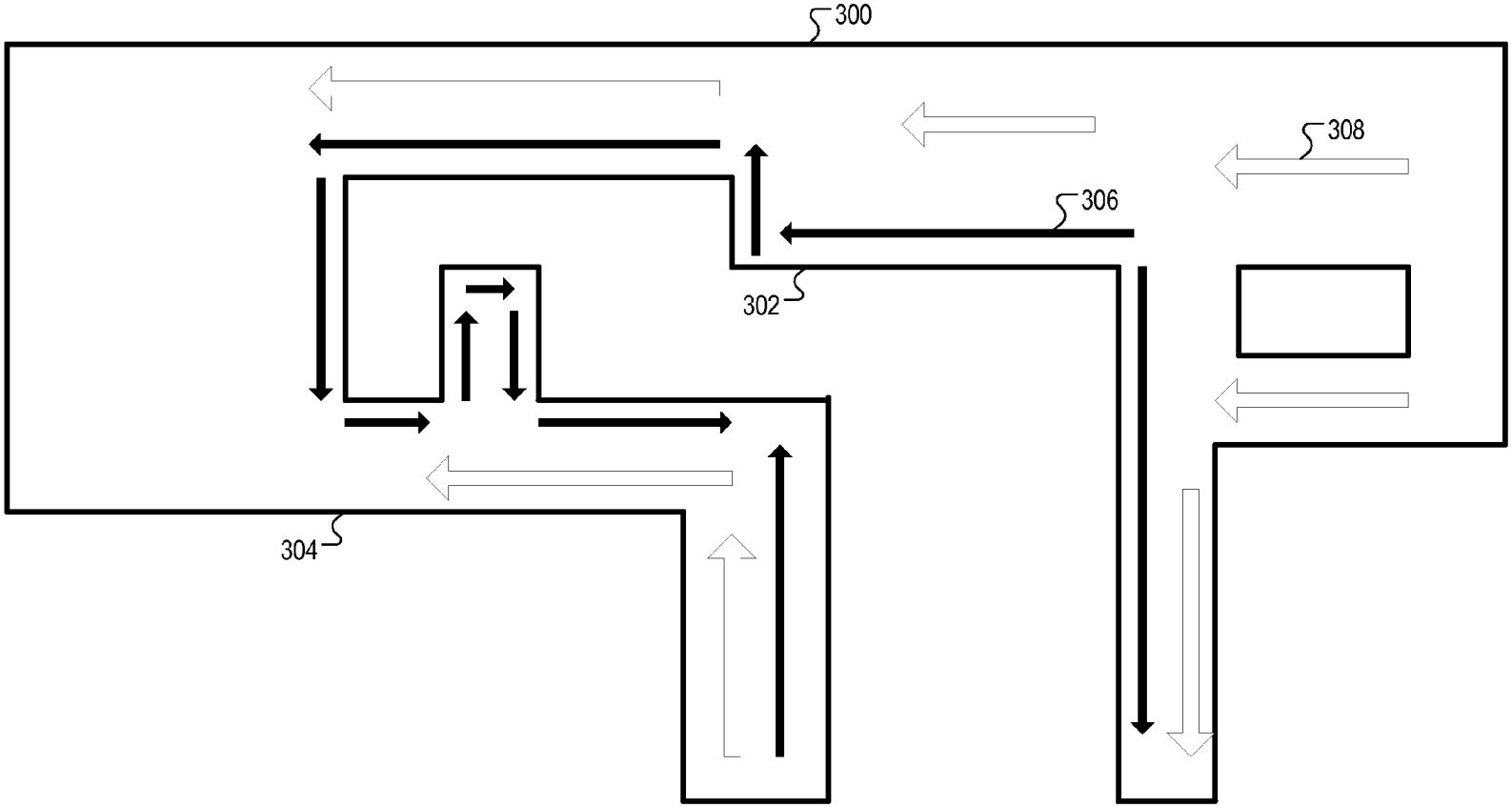
FIG. 3 illustrates a first surface current at low bands and a second surface current at high bands for the dual band antenna structure loop antenna operating in a second order mode according to one embodiment.

FIG. 3 illustrates a first surface current 308 at low bands and a second surface current 306 at high bands for the dual band antenna structure 300 according to one embodiment. The dual band antenna structure 300 can include a slot antenna 302 and a loop antenna 304. In one example, vector surface current distribution of the loop antenna 304 at a low band frequency (f), such as frequency range of approximately 2.1 gigahertz (GHz) to approximately 2.7 GHz, is plotted in FIG. 3. The resonance of the loop antenna 304 at the low band frequency can be $\lambda$. In one example, the slot antenna 302 can be a length of $0.5\lambda$ because the length of 0.5 may be the shortest length at which high radiation can be obtained for a particular frequency for a slot antenna. For example, the length of $0.5\lambda$ may be the shortest length because the surface current distribution may not be uniform and a time varying field can give rise to radiation. The electrons of the current can get accelerated for a quarter of the cycle and then suddenly change their direction and moves in the opposite direction, the same action can be performed for quarter cycle (e.g., $0.5\lambda$ length) so the length of the loop antenna 200 can be $0.5\lambda$. In one example, the first surface current 308 at the low bands can be directed around a perimeter of the loop antenna 304. In another example, the second surface current 306 at the high bands can be directed around the slot antenna 302.

In one embodiment, the loop antenna 304 can operate as a λ loop antenna at a frequency range of approximately 2.1 GHz to approximately 2.7 GHz. One advantage of dual band antenna structure 300 can be to avoid or reduce interference from a presence of metallic structures of the electronic device (such as a metallic housing). For example, the electronic device can have a housing that is primarily metal (such as 90 percent metal). In this example, the metal can affect the performance and interfere with the loop antenna 304 when operating in the first order mode because the surface current doesn't go in the same direction and can cause cancellation. When the loop antenna 304 operates in a second order mode, the surface current can go in same direction for both sided of the antenna which provides a high radiation for the antenna to overcome effects of the interference. In another example, the dual band antenna structure 300 can radiate efficiently at a low band using a second order mode (e.g., λ) of the loop antenna 102 and can radiate efficiently at a high band using a first order slot mode modes (e.g., 0.5λ).

Figure 4:
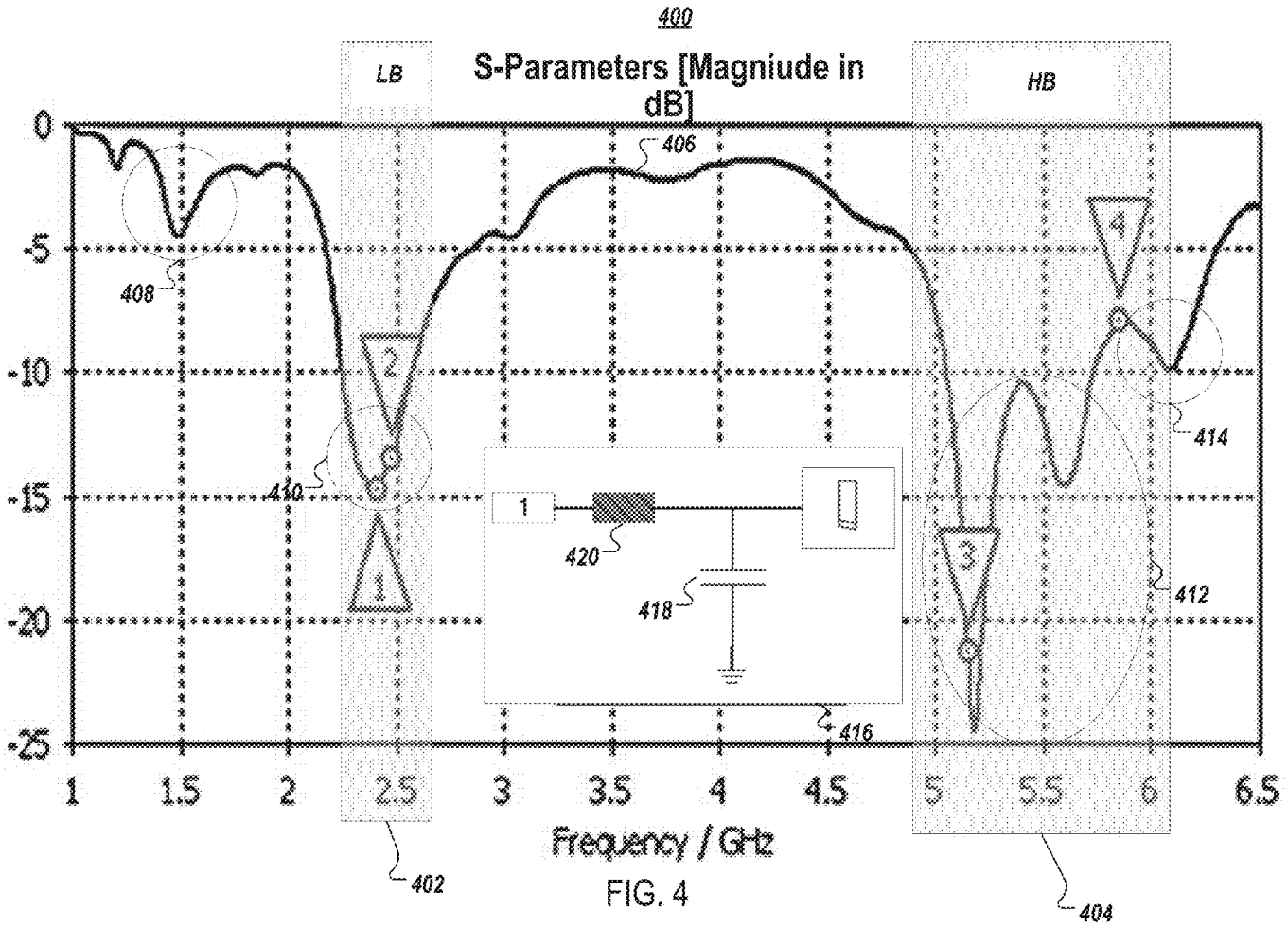
FIG. 4 is a graph of a measured reflection coefficient of the dual band antenna structure according to one embodiment.

FIG. 4 is a graph 400 of a measured reflection coefficient of the dual band antenna structure 100 of FIG. 1A according to one embodiment. The graph 400 shows the measured reflection coefficient (also referred to S-parameter) 406 of the structure of the dual band antenna structure 100 with an impedance matching circuit 416. The impedance matching circuit 416 may be used to accommodate for the reflection coefficient at a low band (LB) 402 for the loop antenna 102 and a high band (HB) 404 for the slot antenna 104 of FIG. 1A. In one embodiment, a first order mode 408 of the loop antenna 102 can cover a frequency range of approximately 1.3 gigahertz (GHz) to approximately 1.7 GHz. In another embodiment, the LB 402 can be a second order mode 410 of the loop antenna 102 and can cover a frequency range of approximately 2.1 gigahertz (GHz) to approximately 2.7 GHz. In another embodiment, the HB 404 can be a first order mode 412 of the slot antenna 104 and can cover a frequency range of approximately 5 GHz to approximately 5.5 GHz. In another embodiment, a third order mode 414 of the loop antenna 102 can cover a frequency range of approximately 6 gigahertz (GHz) to approximately 6.3 GHz. Alternatively, other frequencies in the LB 402 and/or the HB 404 may be covered by the dual band antenna structure 100. As illustrated in FIG. 4, the impedance matching circuit 416 can include a capacitor 418 and an inductor 420. The output of the impedance matching circuit 416 may be coupled to the feed point 124 of the dual band antenna structure 100 of FIG. 1A. The input of the impedance matching circuit 416 may be coupled to an output of a modem or other antenna circuitry of an electronic device. In one embodiment, the impedance matching circuit 416 can be disposed on a PCB. In another embodiment, the capacitor can have a value of 0.7 pF and the inductor have values of 1.1 nH. Alternatively, other capacitor or inductor values may be used.

Figure 5:
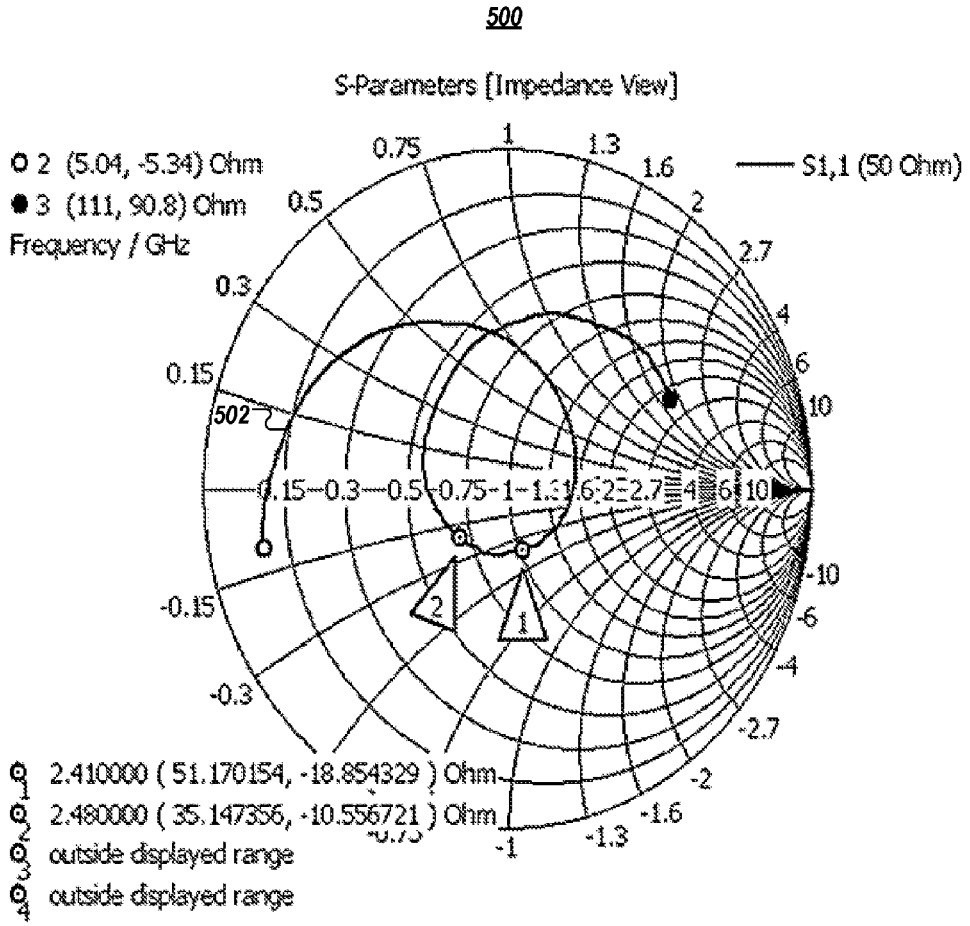
FIG. 5 is a Smith chart of an input impedance of the dual band antenna structure according to one embodiment.

FIG. 5 is a Smith chart 500 of an input impedance of the dual band antenna structure 100 of FIG. 1A according to one embodiment. The Smith chart 500 illustrates how the impedance and reactance behave at the low band of the loop antenna 102 in the second order mode in FIG. 1A. In particular, the line 502 corresponds to the loop antenna 102 operating in frequency range of approximately 2.4 GHz to approximately 2.8 GHz. The Smith chart 500 also illustrates points 1-2 that correlate of points 1-2 in 402 of FIG. 4.

Figure 6:
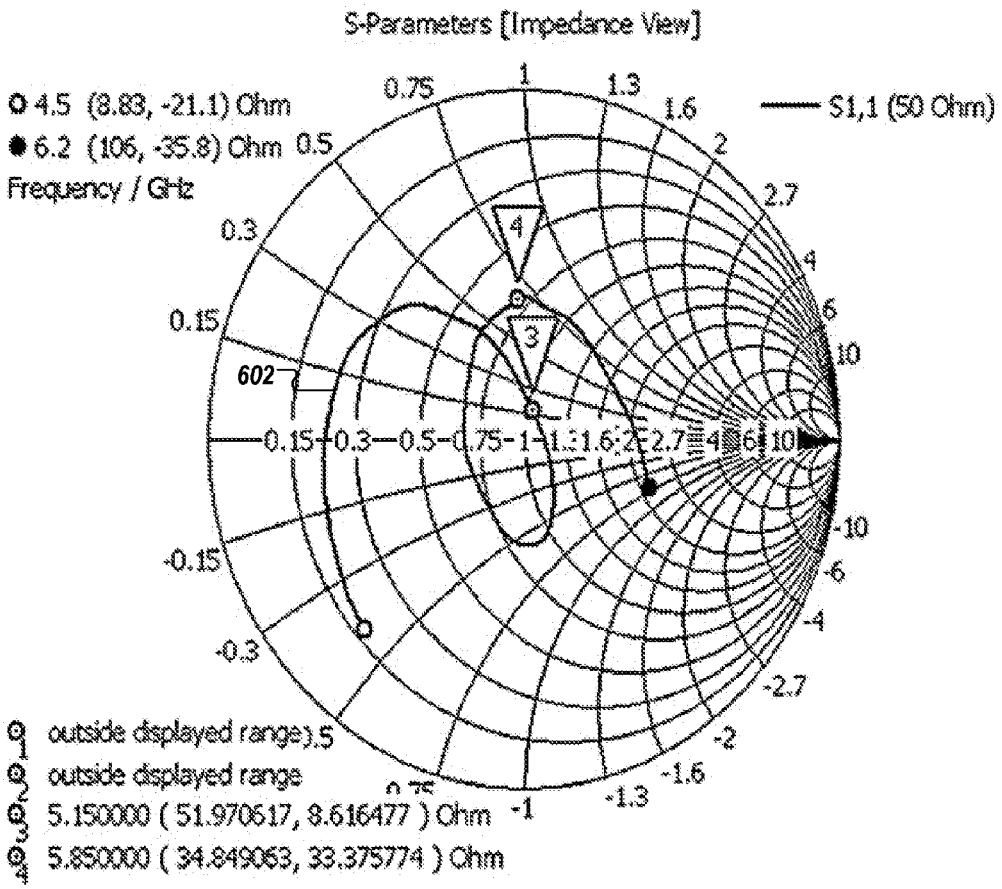
FIG. 6 is a Smith chart of an input impedance of the dual band antenna according to one embodiment.

FIG. 6 is a Smith chart 600 of an input impedance of the dual band antenna structure 100 of FIG. 1A according to one embodiment. The Smith chart 600 illustrates how the impedance and reactance behave at the high band of the slot antenna 104 in the first order mode in FIG. 1A. In particular, the line 602 corresponds to the slot antenna 104 operating in frequency range of approximately 5.15 gigahertz (GHz) to approximately 5.85 GHz. The Smith chart 600 also illustrates points 1-2 that correlate with points 1-2 in 404 of FIG. 4.

Figure 7:
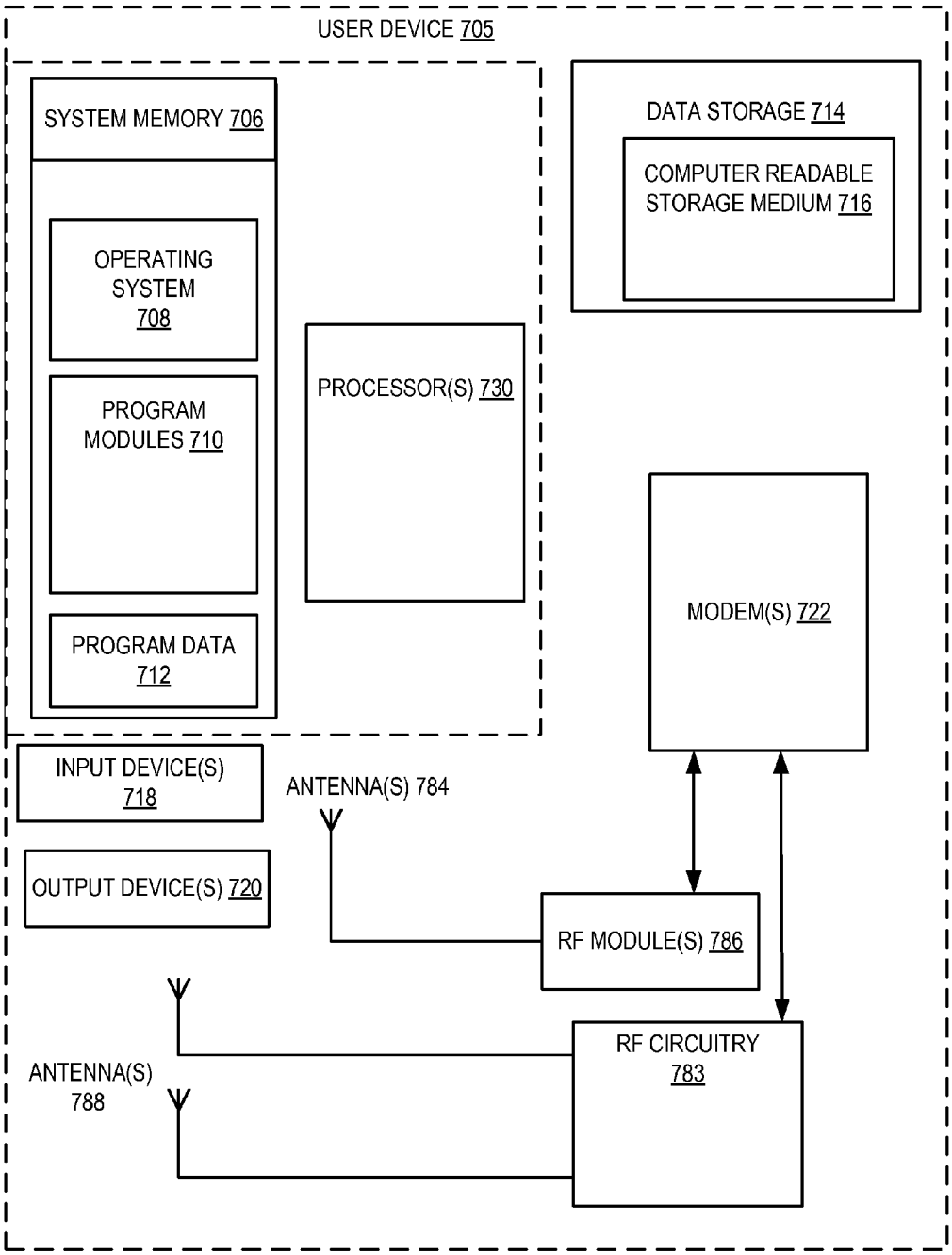
FIG. 7 is a block diagram of a user device in which embodiments of a radio device with an antenna structure may be implemented.

FIG. 7 is a block diagram of a user device 705 in which embodiments of a radio device with an antenna structure may be implemented. Antennas 784 and/or 788 may correspond to the antenna structures of FIGS. 1 and 2. The user device 705 may be any type of computing device such as an electronic book reader, a PDA, a mobile phone, a laptop computer, a portable media player, a tablet computer, a camera, a video camera, a netbook, a desktop computer, a gaming console, a DVD player, a computing pad, a media center, and the like. The user device 705 may be any portable or stationary user device. For example, the user device 705 may be an intelligent voice control and speaker system. Alternatively, the user device 705 can be any other device used in a WLAN network (e.g., Wi-Fi® network), a WAN network, or the like.

The user device 705 includes one or more processor(s) 730, such as one or more CPUs, microcontrollers, field programmable gate arrays, or other types of processors. The user device 705 also includes system memory 706, which may correspond to any combination of volatile and/or non-volatile storage mechanisms. The system memory 706 stores information that provides operating system component 708, various program modules 710, program data 712, and/or other components. In one embodiment, the system memory 706 stores instructions as described herein. The user device 705 performs functions by using the processor(s) 730 to execute instructions provided by the system memory 706.

The user device 705 also includes a data storage device 714 that may be composed of one or more types of removable storage and/or one or more types of non-removable storage. The data storage device 714 includes a computer-readable storage medium 716 on which is stored one or more sets of instructions embodying any of the methodologies or functions described herein. Instructions for the program modules 710 may reside, completely or at least partially, within the computer-readable storage medium 716, system memory 706 and/or within the processor(s) 730 during execution thereof by the user device 705, the system memory 706 and the processor(s) 730 also constituting computer-readable media. The user device 705 may also include one or more input devices 718 (keyboard, mouse device, specialized selection keys, etc.) and one or more output devices 720 (displays, printers, audio output mechanisms, etc.).

The user device 705 further includes a modem 722 to allow the user device 705 to communicate via a wireless network (e.g., such as provided by the wireless communication system) with other computing devices, such as remote computers, an item providing system, and so forth. The modem 722 can be connected to RF circuitry 783 and zero or more RF modules 786. The RF circuitry 783 may be a WLAN module, a WAN module, PAN module, or the like. Antennas 788 are coupled to the RF circuitry 783, which is coupled to the modem 722. Zero or more antennas 784 can be coupled to one or more RF modules 786, which are also connected to the modem 722. The zero or more antennas 784 may be GPS antennas, NFC antennas, other WAN antennas, WLAN or PAN antennas, or the like. The modem 722 allows the user device 705 to handle both voice and non-voice communications (such as communications for text messages, multimedia messages, media downloads, web browsing, etc.) with a wireless communication system. The modem 722 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 722 may generate signals and send these signals to antenna 788, and 784 via RF circuitry 783 and RF module(s) 786 as descried herein. User device 705 may additionally include a WLAN module, a GPS receiver, a PAN transceiver and/or other RF modules. These RF modules may additionally or alternatively be connected to one or more of antennas 784, 788. Antennas 784, 788 may be configured to transmit in different frequency bands and/or using different wireless communication protocols. The antennas 784, 788 may be directional, omnidirectional, or non-directional antennas. In addition to sending data, antennas 784, 788 may also receive data, which is sent to appropriate RF modules connected to the antennas.

In one embodiment, the user device 705 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 722 is shown to control transmission and reception via antenna (784, 888), the user device 705 may alternatively include multiple modems, each of which is configured to transmit/receive data via a different antenna and/or wireless transmission protocol.

The user device 705 delivers and/or receives items, upgrades, and/or other information via the network. For example, the user device 705 may download or receive items from an item providing system. The item providing system receives various requests, instructions and other data from the user device 705 via the network. The item providing system may include one or more machines (e.g., one or more server computer systems, routers, gateways, etc.) that have processing and storage capabilities to provide the above functionality. Communication between the item providing system and the user device 705 may be enabled via any communication infrastructure. One example of such an infrastructure includes a combination of a wide area network (WAN) and wireless infrastructure, which allows a user to use the user device 705 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 705.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 705 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 805 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A user device comprising:

a circuit board comprising a transceiver and a ground plane, wherein the transceiver is configured to output radio frequency (RF) signals; and an antenna structure disposed on an antenna carrier and coupled to the transceiver, wherein the antenna structure comprises a plurality of conductive traces coupled between a feed point and a ground point, wherein the plurality of conductive traces form a loop antenna to radiate electromagnetic energy with a second order mode and gaps between the plurality of conductive traces form a slot antenna to radiate electromagnetic energy in a first order mode, wherein:

the slot antenna comprises:

a first slot in the conductive traces of the antenna structure disposed on the antenna carrier, wherein the first slot comprises:

a first portion that extends from the feed point to a second portion along a latitudinal axis of the antenna structure;

the second portion that is perpendicular to the first portion and extends in a first direction from the first portion to a third portion along a longitudinal axis of the antenna structure;

the third portion that is perpendicular to the second portion and extends from the second portion to a fourth portion along the latitudinal axis;

the fourth portion that is perpendicular to the third portion and extends from the third portion to a fifth portion along the longitudinal axis;

the fifth portion that is perpendicular to the fourth portion and extends from the fourth portion to a sixth portion along the latitudinal axis; and the sixth portion that is perpendicular to the fifth portion and extends from the fifth portion along the longitudinal axis; and a second slot, wherein the second slot comprises:

a seventh portion that is perpendicular to the first portion and extends in a second direction from the first portion along the longitudinal axis; and the loop antenna comprises:

an eighth portion that perpendicularly extends from the feed point to a ninth portion along the latitudinal axis;

the ninth portion that is perpendicular to the eighth portion and extends from the eighth portion to a tenth portion along the longitudinal axis;

the tenth portion that is parallel to the ninth portion and can extend from the ninth portion to an eleventh portion along the longitudinal axis;

the eleventh portion that is parallel to the tenth portion and extends from the tenth portion to a twelfth portion along the longitudinal axis; and the twelfth portion that is perpendicular to the eleventh portion and extends from the eleventh portion to the ground point along the latitudinal axis.

2. The user device of claim 1, wherein at least a portion of the eighth portion, the tenth portion, and the twelfth portion of the loop antenna are disposed along a first side of the antenna carrier and another portion of the eighth portion, the tenth portion, and the twelfth portion are disposed on a second side of the antenna carrier.

3. The user device of claim 1, wherein the seventh portion has an RF short connecting a first side of the conductive traces along the seventh portion together with a second side of the conductive traces along the seventh portion.

4. An antenna structure comprising:

a radio frequency (RF) circuit;

an antenna carrier;

conductive material disposed on the antenna carrier and coupled to the RF circuit, wherein:

the conductive material is operable to radiate or receive first electromagnetic energy as a loop antenna in a first frequency band in a second order mode, wherein the loop antenna is operable to radiate at a wavelength (λ) in the second order mode;

the conductive material comprising a first slot between first portions of the conductive material and a second slot between second portions of the conductive material;

the first slot or the second slot is operable to radiate or receive second electromagnetic energy as a slot antenna at a second frequency band in a first order mode, wherein the slot antenna is operable to radiate at a 0.5λ in the first order mode; and the second frequency band is higher than the first frequency band.

5. The antenna structure of claim 4, wherein:

the first slot comprises:

a first portion that extends from a feed point coupled to the conductive material to a second portion along a latitudinal axis;

the second portion that is perpendicular to the first portion and extends in a first direction from the first portion to a third portion along a longitudinal axis;

the third portion that is perpendicular to the second portion and extends from the second portion to a fourth portion along the latitudinal axis;

the fourth portion that is perpendicular to the third portion and extends from the third portion to a fifth portion along the longitudinal axis;

the fifth portion that is perpendicular to the fourth portion and extends from the fourth portion to a sixth portion along the latitudinal axis; and the sixth portion that is perpendicular to the fifth portion and extends from the fifth portion along the longitudinal axis; and the second slot comprises:

a seventh portion that is perpendicular to the first portion and extends in a second direction from the first portion along the longitudinal axis.

6. The antenna structure of claim 5, wherein the second slot has an RF short connecting a first side of the conductive material along the second slot together with a second side of the conductive material along the second slot.

7. The antenna structure of claim 6, wherein the first slot is in a dominant mode to radiate electromagnetic energy at a resonant frequency of the antenna structure and the second slot is in a non-dominant mode to not radiate electromagnetic energy.

8. The antenna structure of claim 7, wherein the first slot has a first length larger than a second length of the second slot and the first slot radiates or receives electromagnetic energy.

9. The antenna structure of claim 4, wherein the loop antenna comprises:

an eighth portion that perpendicularly extends from a feed point to a ninth portion along a latitudinal axis;

the ninth portion that is perpendicular to the eighth portion and extends from the eighth portion to a tenth portion along a longitudinal axis;

the tenth portion that is parallel to the ninth portion and can extend from the ninth portion to an eleventh portion along the longitudinal axis;

the eleventh portion that is parallel to the tenth portion and extends from the tenth portion to a twelfth portion along the longitudinal axis; and the twelfth portion that is perpendicular to the eleventh portion and extends from the eleventh portion to a ground point along the latitudinal axis.

10. The antenna structure of claim 4, wherein:

the loop antenna is configured to radiate electromagnetic energy in a first frequency range between approximately 2.1 GHz to approximately 2.7 GHz; and the slot antenna is configured to radiate electromagnetic energy in a second frequency range between approximately 5 GHz to approximately 5.5 GHz.

11. A user device comprising:

a circuit board comprising a transceiver and a ground plane, wherein the transceiver is configured to output radio frequency (RF) signals; and an antenna structure disposed on an antenna carrier comprising:

conductive material disposed to form a loop antenna to radiate electromagnetic energy in a second order mode, wherein the loop antenna is configured to radiate electromagnetic energy in a first frequency range between approximately 2.1 GHz to approximately 2.7 GHz;

a first slot formed between portions of the conductive material; and a second slot formed between other portions of the conductive material, the first slot and second slot to operate as a slot antenna in a first order mode, wherein the slot antenna is configured to radiate electromagnetic energy in a second frequency range between approximately 5 GHz to approximately 5.5 GHz.

12. The user device of claim 11, wherein:

the first slot comprises:

a first portion that extends from an opening to a second portion along a latitudinal axis of the antenna structure;

the second portion that is perpendicular to the first portion and extends in a first direction from the first portion to a third portion along a longitudinal axis of the antenna structure;

the third portion that is perpendicular to the second portion and extends from the second portion to a fourth portion along the latitudinal axis;

the fourth portion that is perpendicular to the third portion and extends from the third portion to a fifth portion along the longitudinal axis;

the fifth portion that is perpendicular to the fourth portion and extends from the fourth portion to a sixth portion along the latitudinal axis; and the sixth portion that is perpendicular to the fifth portion and extends from the fifth portion along the longitudinal axis; and the second slot comprises:

a seventh portion that is perpendicular to the first portion and extends in a second direction from the first portion along the longitudinal axis.

13. The user device of claim 12, wherein the second slot has an RF short connecting a first side of the conductive material along the second slot together with a second side of the conductive material along the second slot.

14. The user device of claim 12, wherein the first slot is in a dominant mode to radiate electromagnetic energy and the second slot is in a non-dominant mode to not radiate electromagnetic energy.

15. The user device of claim 14, wherein the first slot has a first length larger than a second length of the second slot and the first slot radiates or receives electromagnetic energy.

16. The user device of claim 11, wherein the loop antenna comprises:

an eighth portion that perpendicularly extends from a feed point to a ninth portion along a latitudinal axis of the antenna structure;

the ninth portion that is perpendicular to the eighth portion and extends from the eighth portion to a tenth portion along a longitudinal axis of the antenna structure;

the tenth portion that is parallel to the ninth portion and can extend from the ninth portion to an eleventh portion along the longitudinal axis;

the eleventh portion that is parallel to the tenth portion and extends from the tenth portion to a twelfth portion along the longitudinal axis; and the twelfth portion that is perpendicular to the eleventh portion and extends from the eleventh portion to a ground point along the latitudinal axis.

17. The user device of claim 16, wherein at least a portion of the eighth portion, the tenth portion, and the twelfth portion of the loop antenna are disposed along a first side and another portion of the eighth portion, the tenth portion, and the twelfth portion are disposed on a second side of the antenna carrier.

18. The user device of claim 11, wherein:

the slot antenna is configured to radiate at 0.5 wavelength ($\lambda$) in the first order mode; and the loop antenna is configured to radiate at a wavelength ($\lambda$) in the second order mode.

* * * * *